United States Patent [19]

Allen

[11] Patent Number: 4,624,276

[45] Date of Patent: Nov. 25, 1986

[54] UMBRELLA HANDLE

[75] Inventor: James H. Allen, Covington, Ky.

[73] Assignee: 'totes', incorporated, Loveland, Ohio

[21] Appl. No.: 512,606

[22] Filed: Jul. 11, 1983

Related U.S. Application Data

[63] Continuation-in-part of Ser. No. 322,859, Nov. 19, 1981, abandoned.

[51] Int. Cl.[4] ..... A45B 25/00

[52] U.S. Cl. ..... 135/20 R; 16/110.5; 294/171

[58] Field of Search ..... 135/16, 17, 18, 19, 135/19.5, 20 R, 20 A, 20 B, 20 M, 21, 22, 23, 24, 25, 26; 215/100 A, 100 R; 150/48; 16/DIG. 18, DIG. 19, DIG. 24, DIG. 25, 110 R, 111 R, 114 B, 122, 123, DIG. 12

[56] References Cited

U.S. PATENT DOCUMENTS

| | | | |
|---|---|---|---|
| 48,462 | 6/1865 | Taylor | 224/251 |
| 743,945 | 11/1903 | Saden | 294/171 |
| 809,551 | 1/1906 | Brunner . | |
| 1,218,859 | 3/1917 | Hess | 294/171 |
| 1,270,207 | 6/1918 | Preston | 224/250 X |
| 1,580,864 | 4/1926 | Stevenson | 135/19.5 |
| 1,665,900 | 4/1928 | Vaughan | 294/150 |
| 1,931,078 | 10/1933 | McWilliams | 16/110.5 UX |
| 2,041,691 | 5/1936 | Becklin | 294/171 |
| 2,114,598 | 4/1938 | Grissel | 135/20 R |
| 2,128,634 | 8/1938 | Capaldo | 135/20 R |
| 2,745,569 | 5/1956 | Seaman . | |
| 3,259,285 | 7/1966 | Bush | 294/170 X |
| 3,580,262 | 5/1971 | Weber | 135/20 R |
| 3,819,108 | 6/1974 | Jordan | 273/84 ES X |

FOREIGN PATENT DOCUMENTS

| | | | |
|---|---|---|---|
| 935733 | 2/1948 | France | 135/20 R |
| 995362 | 11/1951 | France . | |
| 1219378 | 1/1971 | United Kingdom | 135/26 |

*Primary Examiner*—Robert A. Hafer
*Assistant Examiner*—Arnold W. Kramer
*Attorney, Agent, or Firm*—Wood, Herron & Evans

[57] ABSTRACT

An umbrella handle with a unique structure that allows a carrying strap to be stored on the handle's exterior surface when not in use so as to be substantially flush with the exterior surface.

13 Claims, 11 Drawing Figures

UMBRELLA HANDLE

This application is a continuation-in-part of U.S. application Ser. No. 322,859, filed Nov. 19, 1981, entitled Umbrella Handle, invented by James H. Allen, and assigned to the assignee of this application. That prior application is now abandoned.

This invention relates to umbrellas. More particularly, this invention relates to umbrella handles.

Umbrellas are, of course, very widely known to the prior art. An umbrella basically includes a handle at one end of a centerpost, and a canopy and rib structure at the other end of the centerpost. The purpose of the handle, of course, is to allow the umbrella's user to easily grasp and hold the umbrella when it is open and being used in the rain. In the case of a collapsible umbrella, i.e., an umbrella with a collapsible centerpost, it is also well known to the prior art to connect a flexible carrying strap with the umbrella's handle. The carrying strap is used primarily when the umbrella is in the collapsed position, and allows the umbrella to be easily held and carried by the umbrella's owner when the umbrella is collapsed. The carrying strap is often in the form of a flexible chain loop or a flexible vinyl band loop.

As heretofore known to the prior art, a collapsible umbrella's flexible carrying strap is connected at one end to the umbrella's handle, and the strap simply swings free therefrom at all times. In other words, the carrying strap has no stowed position relative to the umbrella since it is connected only at one end to the umbrella's handle, and is therefor always free to swing or move relative thereto. Since umbrellas of the collapsible type are now on the market which are short enough to be stored in, for example, a woman's handbag or a man's briefcase, a carrying strap which is connected to the collapsible umbrella's handle may catch or otherwise become lodged in or between other articles carried in the handbag or briefcase. If this occurs, it tends to cause disorder problems for those items when the umbrella is withdrawn from its storage location by the umbrella's user.

Accordingly, it is the primary objective of this invention to provide an umbrella handle for an umbrella, the handle having a flexible carrying strap attached thereto that may be located in a stowed position on the handle's exterior surface.

It has been another objective of this invention to provide an improved umbrella handle for an umbrella, a flexible carrying strap connected to the handle that is stowable on the handle's surface, and a fastener connected to at least one of the strap and the handle for cooperating with the strap to retain it in the stowed position.

It has been a further objective of this invention to provide an improved umbrella handle for an umbrella, a flexible carrying strap connected to the handle, and surface structure on the handle that is cooperable with the strap to hold the strap in a friction fit stowed position on the handle's surface.

In accord with these objectives, each embodiment of the improved umbrella handle of this invention includes a flexible strap connected at one end to that handle. The other end of the strap is adapted to swing free during use of the strap when the strap is released from the handle, i.e., when the strap is not in a stowed position. In one embodiment, the carrying handle is provided with a recess on its outer surface. The strap includes a fastener which, when the strap is wrapped around the carrying handle within the recess, functions to retain the strap in the stowed position. In another embodiment, the carrying handle also is provided with a recess on its outer surface. But the strap is sized relative to that recess so that when the strap is press fit into that recess it is held in the stowed position due to that friction fit, thereby eliminating the need for a separate fastener.

Other objectives and advantages of this invention will be more apparent from the following detailed description taken in conjunction with the drawings in which.

Figure 1:
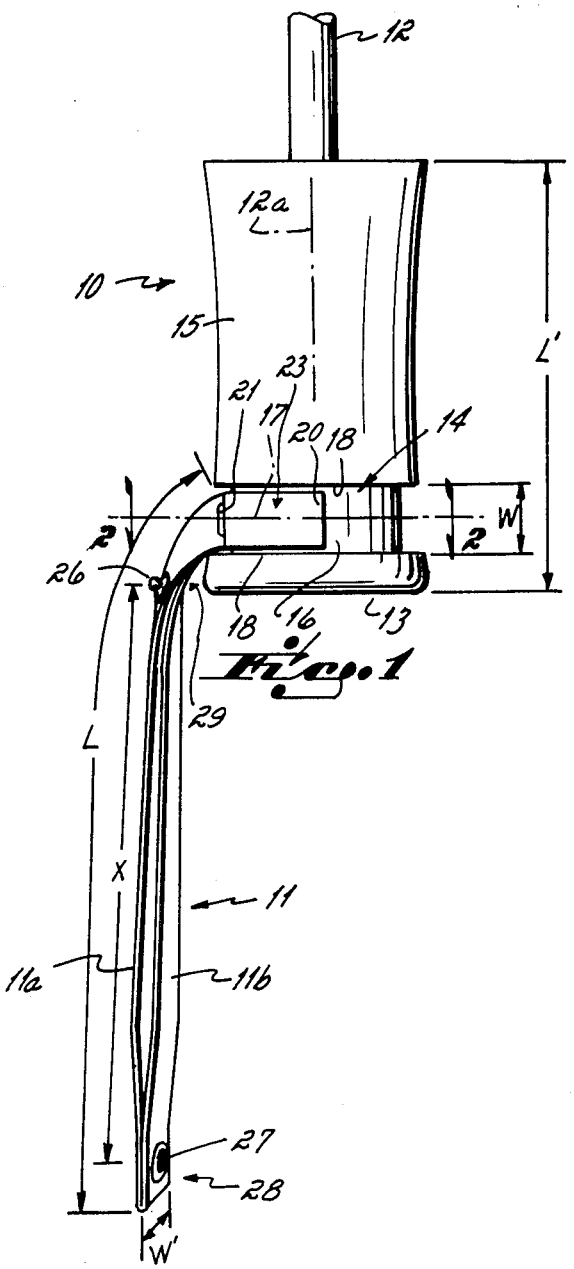
FIG. 1 is a side elevational view illustrating a first embodiment of an umbrella handle with carrying strap in accord with the principles of this invention, the carrying strap being shown in the released position.
Figure 2:
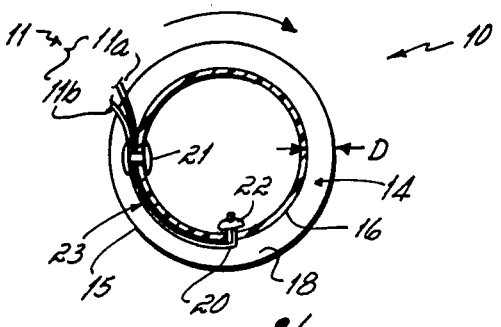
FIG. 2 is a cross-sectional view taken along line 2—2 of FIG. 1.

A generally round umbrella handle 10 with flexible carrying strap 11 in accord with the principles of this invention is shown in FIG. 1. The umbrella handle 10 is fixed to an umbrella centerpost 12 at one end, the other end (not shown) of that centerpost being connected with the umbrella's cover (not shown) and rib structure (not shown). The round umbrella handle 10 may be of a molded one piece configuration as shown. Note particularly that the umbrella handle 10, adjacent the bottom end 13, includes a peripheral recess or groove 14 on the handle's exterior surface 15. The peripheral recess 14 is of a width W, and includes a floor 16 and side walls 18, 18. Thus, the recess' floor 16 is set inward from the general side wall surface 15 of the handle. This peripheral recess 14, in the embodiment shown, is an annular recess that is circular in cross-section as shown in FIG. 2, the phantom center plane or line 17 of the groove being disposed generally perpendicular to the longitudinal axis 12*a* of the umbrella's handle 10 and centerpost 12.

The flexible carrying strap 11 attached to the handle 10 is completely flexible throughout its length L. The carrying strap 11 is of a width W′ not greater than the width W of the recess 14. That end 20 of the carrying strap 11 which is connected to the umbrella's hollow handle 10 is so connected within recess 14 by a double head rivet 21 spaced inwardly from that end of the carrying strap, and by a tit 22 on the end of the carrying strap, same cooperating to provide an end section 23 of the carrying strap which is aligned within the handle's recess and fixed to the recess' floor 16 at all times as shown in FIG. 2.

The carrying strap 11 itself is in the form of a loop configuration as shown in FIG. 1; the looped strap 11 may be formed from a metal or plastic chain, but is formed from a vinyl band in the embodiment shown. Note the length L of the looped carrying strap 11 is such that a human's hand can pass therethrough, i.e., is substantially greater than the length L' of the handle 10.

Figure 4:
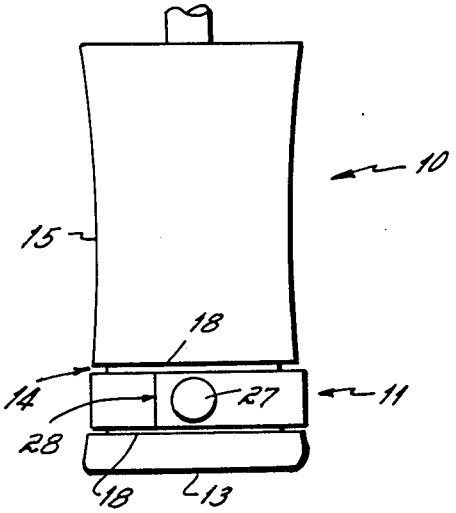
FIG. 4 is a view similar to FIGS. 1 and 3 but showing the carrying strap in the final stowed position.

Preferably the length L of the looped carrying strap 11 relative to the depth D of the recess 14 in the handle's surface 15 is such that the strap does not extend significantly beyond the handle's surface when the carrying strap 11 is wound about the handle within the recess in the stowed position shown in FIG. 4. In the stowed position, therefor, the strap 11 tends to function to some extent as a continuation of the handle surface 15 over the recess 14, thereby providing a desirable feel to the handle 10 adjacent the bottom 13 of the handle when the strap is stowed; this is particularly the case when the carrying strap 11 is of a band width W' substantially equal to the width W of recess 14. The carrying strap 11, adjacent that end section 23 which is connected to the handle 10, is provided with one-half 26 of holding means in the form of a snap fastener 26, 27, that one-half 26 being connected on outer side band 11*a* of the loop's two bands 11*a*, 11*b*. The other half 27 of the snap fastener 26, 27 is connected to the free end 28 of the carrying strap 11. That half of the fastener 26 connected to the handle end 29 of the carrying strap 11 is connected to only one band 11*a* of the strap as is shown in FIG. 1, but that end of the fastener which is connected to the free end 28 of the strap is connected through both bands 11*a*, 11*b* of the strap, also as shown in FIG. 1.

Figure 3:
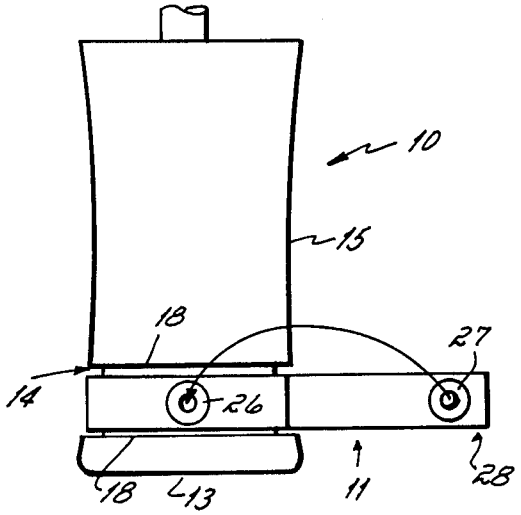
FIG. 3 is a side elevational view similar to FIG. 1 but showing the carrying strap being wrapped around the handle toward the stowed position.

In the use of the improved handle 10 of this invention, and when it is desired to translate the carrying strap 11 from the use position shown in FIG. 1 at which the strap's free end 28 swings free to the stowed position shown in FIG. 4 at which the strap's free end does not swing free, the strap need merely be grasped at its free end 28 and wound around the handle 10 so that it is wound in spiral configuration within the recess 14, as partially shown in FIG. 3. The distance X between the two fastener halves 26, 27 on the carrying strap 11 vis-a-vis the length or circumference of the recess' floor 16 is such that the strap's free end fastener 27 will be interconnectable with the strap's handle end fastener 26 when the strap 11 is finally wound in stowed position as shown in FIG. 4 so that the strap is retained on the handle in the stowed configuration shown in FIG. 4. As will be apparent to those skilled in the art, and in order to translate the strap from the stowed configuration of FIG. 4 to the release or use configuration of FIG. 1, the storage steps need merely be reversed in sequence.

Figure 5:
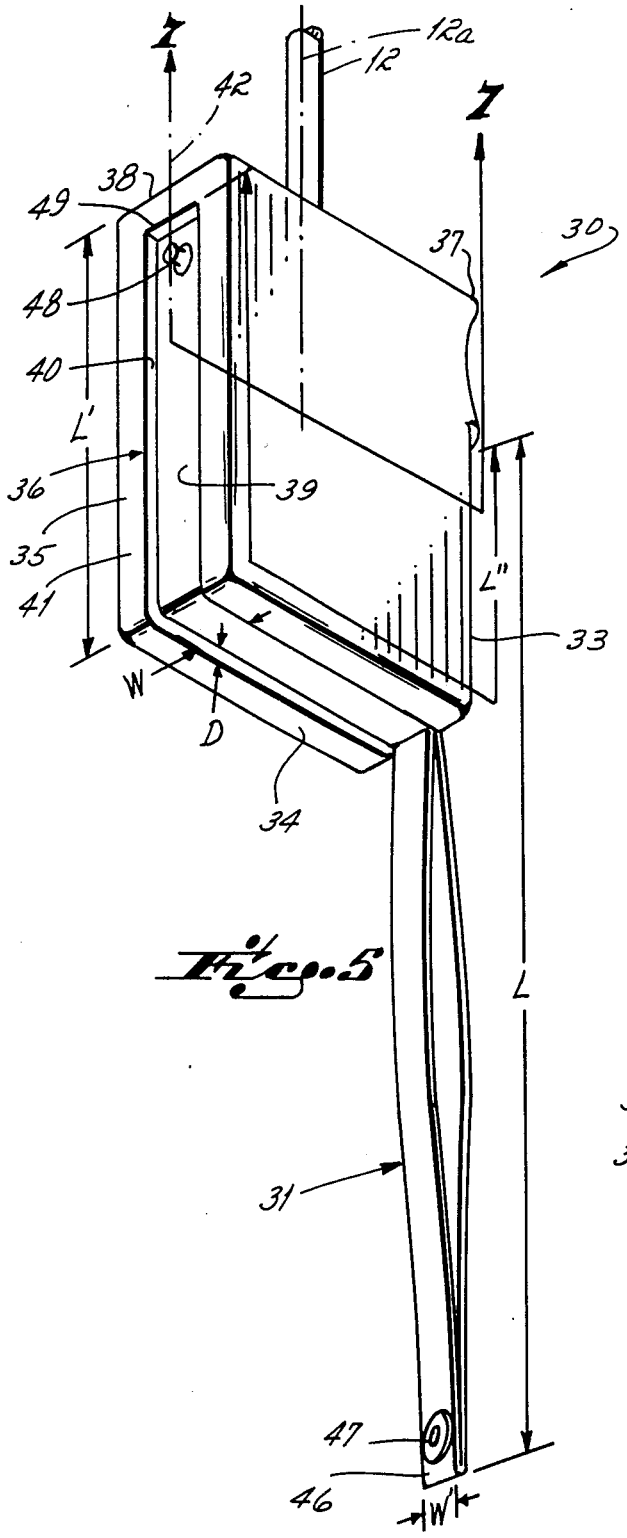
FIG. 5 is a side perspective view illustrating a second embodiment of an umbrella handle with carrying strap in accord with the principles of this invention, the carrying strap being shown in the released position.
Figure 6:
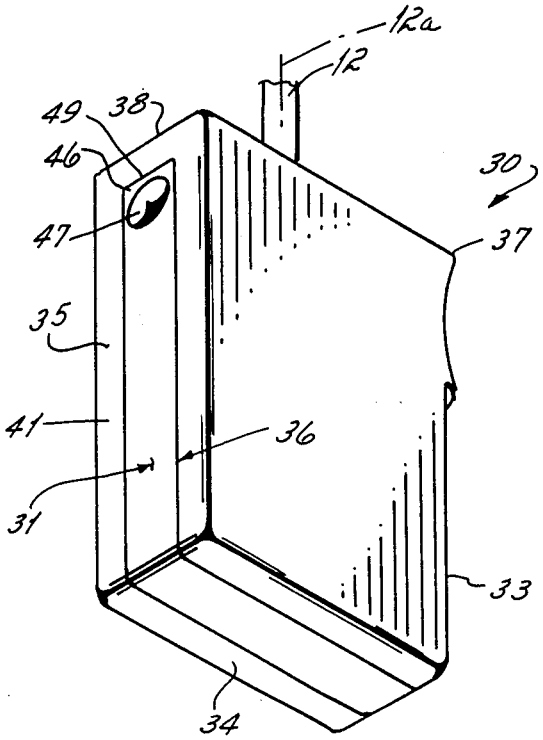
FIG. 6 is a view similar to FIG. 5 but illustrating the carrying strap in the final stowed position.
Figure 7:
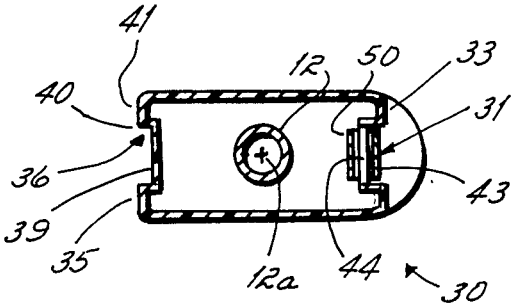
FIG. 7 is a cross-sectional view taken along line 7—7 of FIG. 5.

A generally flat umbrella handle 30 with flexible strap 31 in accord with the principles of this invention is shown in FIGS. 5–7. The umbrella handle 30 is fixed to an umbrella centerpost 12 at one end, the other end (not shown) of that centerpost being connected with the umbrella's cover (not shown) and rib structure (not shown). The flat umbrella handle 30 may be of a molded one piece configuration as shown.

The flat umbrella handle 30, on those three edges 33–35 thereof which are available to a user's hand, defines a continuous peripheral recess 36 from the top edge 37 of the handle at one side edge 33 around the bottom edge 34 and up to the top edge 38 of the handle on the other side edge 35. The peripheral recess or groove 36, which is on three side edges of the handle only, i.e., which does not extend completely around the handle's periphery, is of a width W, and includes a floor 39 and side walls 40. Thus, the recess' floor 39 is set inward from the side edges' surfaces 41 of the flat handle 30. This edge recess 36, in the embodiment shown, defines a phantom center plane 42 that is co-extensive with, i.e., includes, the longitudinal axis 12*a* of the umbrella's handle 30 and centerpost 12.

The flexible strap 31 attached to the handle is completely flexible throughout its length L, and is in the form of a closed loop. The carrying strap is of a width W' not greater than the width W of the recess 36. That end 43 of the carrying strap which is connected to the umbrella handle 30 is so connected by use of a bar 44 molded integral with the handle, see FIG. 7. As with the carrying strap 11 in the first embodiment shown in FIGS. 1–4, the looped strap 31 may be formed from a metal or plastic chain, but is formed from a vinyl band in the embodiment shown. Note the length L of the looped strap 31 is such that a user's hand can pass therethrough, i.e., is substantially greater than the length L' of the handle. Preferably the thickness of the looped carrying strap 31 relative to the depth D of the recess 36 in the handle's edge surfaces 33–35 is such that the strap does not extend significantly beyond the handle's edge surfaces 41 when the carrying strap is placed within that recess in the stowed position shown in FIG. 6. In the stowed position, therefore, the strap 31 tends to function to some extent as a continuation of the handle's edge surfaces 41, thereby providing a not undesirable feel to the handle 30 when the strap is stowed; this is particularly the case when the carrying strap is of a band width W' substantially less than the width W of the recess 36.

The carrying strap 31, adjacent that end 46 which is connectable to and disconnectable from the handle 30, is provided with one-half 47 of holding means in the form of a snap fastener. In other words, snap fastener part 47 is connected to the free end 46 of strap 31. The other half 48 of the snap fastener is fixed to the umbrella handle 30 on the floor 39 of the handle's recess 36 at that end 49 of the recess opposite to the end 50 to which the strap is permanently connected, see FIG. 5. This permits the strap 31 to be stored in a generally line configuration on the side edge surfaces 41 of the handle.

In use of the second embodiment of the umbrella handle 30, and when it is desired to translate the carrying strap 31 from the use position shown in FIG. 5 at which the strap's free end 46 swings free to the stowed position shown in FIG. 6 at which the strap's free end does not swing free, the strap need merely be grasped at its free end and positioned within the handle's recess. Since the strap's length L is substantially the same as the recess' length L'' from one end of the recess to the other, that fastener part 47 fixed to the strap 31 will overlie that fastener part 48 fixed to the handle 30 when it is stowed so that the strap can be thereby fastened within the recess 36 . As will be apparent to those skilled in the art, and in order to translate the strap 31 from the stowed configuration of FIG. 6 to the release or use position of FIG. 5, the storage steps need merely be reversed in sequence.

Figure 8:
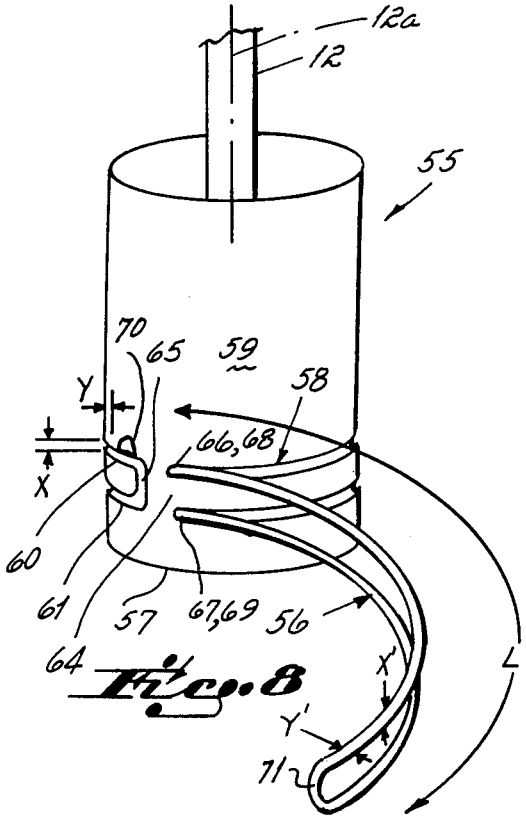
FIG. 8 is a side perspective view illustrating a third embodiment of an umbrella handle with carrying strap in accord with the principles of this invention, the carrying strap being shown in the released position.
Figure 9:
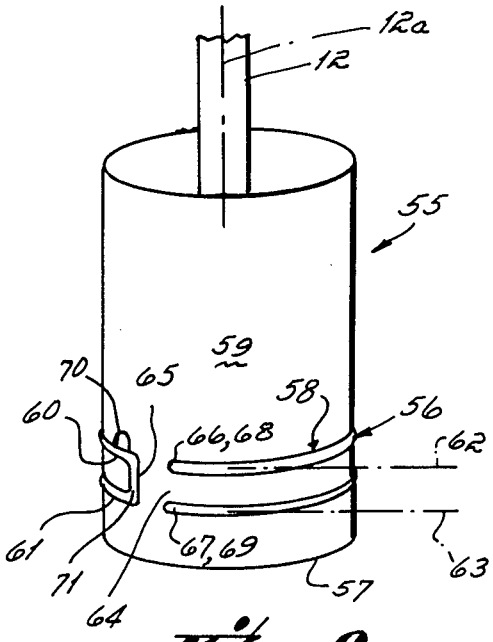
FIG. 9 is a view similar to FIG. 8 but showing the carrying strap in the final stowed position.

A third embodiment of an umbrella handle 55 with flexible carrying strap 56 in accord with the principles of this invention is shown in FIGS. 8 and 9. In this particular embodiment, the umbrella handle 55 is of a round configuration and is of a molded one piece configuration as shown. Note particularly that adjacent the bottom end 57 of that handle 55 there is provided a double groove 58 that is in the form of an elongated open ended loop on the handle's exterior surface 59. The open ended loop 58 is comprised of two main grooves or recesses 60, 61 parallel one to the other, those recesses each being in a phantom center plane 62, 63 that is disposed generally perpendicular to the longitudinal axis 12*a* of the umbrella handle 55 and centerpost 12. The two main grooves or recesses 60, 61 are disconnected one from another at the open end 64 of the open ended loop 58, but are connected one to another by connector groove or recess 65 at the closed end of the open ended loop. The width X of these grooves 60, 61, 65 is the same from end 66 of main groove 60 through connector groove 65 to end 67 of main groove 61. Also, preferably the depth Y of these grooves 60, 61, 65 is the same from end 66 to end 67 of the grooves. The width X and depth Y of the groves or recesses 60, 61, 65 is very important relative to the width X' of the strap 56 as is explained in greater detail below.

The flexible strap 56 attached to the handle 55 is completely flexible throughout its length. The strap 56 may be of a length L such that a human's hand can pass therethrough, but also may be of a length sufficient only to permit the loop to hang over a hook or the like. In the latter event, the strap 56 is useful to hang the umbrella from a peg in a closet or the like. Importantly relative to this third embodiment, the strap 56 is of a width X' slightly greater than the width X of the grooves 60, 61, 65. Also, preferably the strap 56 is of a depth Y' not substantially greater than the depth Y of the grooves 60, 61, 65. The width X' and depth Y' of strap 56 is the same from one end 68 of the strap to the other end 69 of the strap. In light of the strap's width X' and depth Y' vis-a-vis the width X and depth Y of grooves 60, 61, 65, the strap 56 is receivable within the grooves 60, 61, 65 throughout its length in a press fit or friction fit type relationship, which friction fit defines holding means for retaining the strap 56 in its stowed position. Since the overall length of the grooves 60, 61, 65 is substantially equivalent to the overall length of the strap 56, all segments of the strap are securely press fit into the recess to establish the stowed configuration shown in FIG. 9. In this embodiment, therefore, the strap 56 and/or handle 55 must be fabricated of a material that permits the strap to be press fit or friction fit into the grooves 60, 61, 65 molded into the handle's exterior surface 59. This allows the strap 56 to be stowed in an open ended loop type configuration on the handle's surface 59.

In this third embodiment, the umbrella handle 55 also is provided with a fingernail recess 70 adjacent to the connector groove 65. The fingernail recess 70 permits the looped strap 56 to be removed from friction fit relation with the umbrella handle 55 at the free end 71 of that loop so it can be "peeled" out of the grooves 60, 61, 65 when use thereof is desired. Note particularly this third embodiment of an umbrella handle 55 eliminates the need for a separate fastener element at the free end of the loop, as well as eliminates the need for a fastener element connected to the handle. This for the reason, of course, that the sizing of the strap 56 vis-a-vis the sizing of the open ended double groove 60, 61, 65 is such that the strap is held in stowed configuration with the handle simply by being press fit within the handle's grooves.

Figure 10:
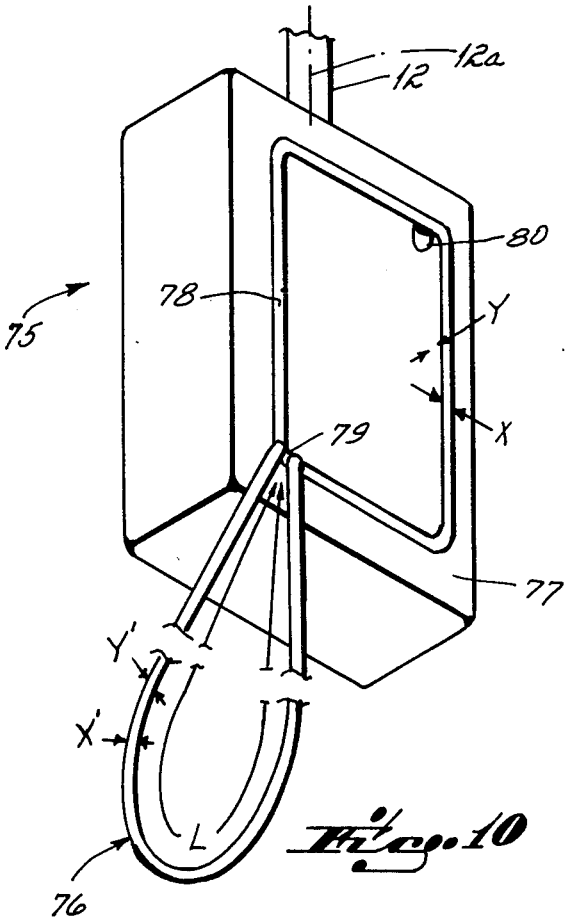
FIG. 10 is a side perspective view illustrating a fourth embodiment of an umbrella handle with carrying strap in accord with the principles of this invention, the carrying strap being shown in the released position.
Figure 11:
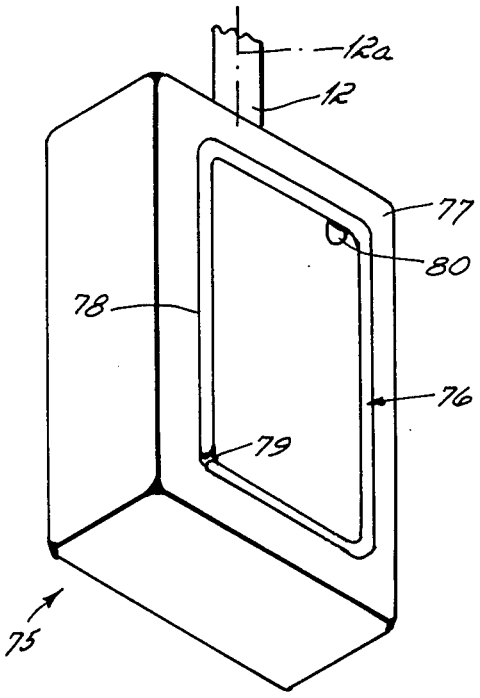
FIG. 11 is a view similar to FIG. 10 but showing the carrying strap in the final stowed position.

A fourth embodiment of an umbrella handle 75 with flexible strap 76 in accord with the principles of this invention is shown in FIGS. 10 and 11. This particular handle 75 is of a flat configuration, and the strap 76 is stowed all on one side surface 77 of the handle in a generally closed loop configuration. The closed loop groove 78 provided in the umbrella handle's surface 77 is an endless groove that is of a width X slightly less than the width X' of the strap 76, and is of a depth Y slightly not substantially greater than the depth Y' of the strap. The strap 76 is connected to the handle 75 at one corner 79 of the endless, generally rectangular configured recess 78 provided in the handle's side wall surface. The overall length L of the strap 76 is such that only a user's finger can be inserted through the loop defined thereby, or the strap loop can be hung on a closet hook to hang up the umbrella, when the strap is not stowed on the umbrella's surface.

When it is desired to stow the strap 76 loop on the handle surface 77, the strap is simply press fit or friction fit into the looped groove 78 provided on the handle's surface, thereby establishing holding means for retaining the strap in the stowed position. Since the groove 78 is of a peripheral length equivalent to the peripheral length of the loop defined by the strap 76, the loop fits securely therein. The press fit or friction fit of the strap 76 within the groove 78 holds it in the stowed configuration. When removal of the loop is desired from the handle's surface, fingernail recess 80 molded into the handle's surface permits a user's fingernail to begin lifting the strap 76 from the groove 78. The strap 76 is then simply "peeled" out of the groove as explained hereinabove for the FIGS. 8 and 9 embodiment.

Having described in detail the preferred embodiment of my invention, what I desire to claim and protect by Letters Patent is:

1. An umbrella having a cover, a rib structure for erecting and collapsing said cover, and a centerpost, the improvement comprising an umbrella handle having an exterior surface and a strap receiving recess formed therein, a flexible carrying strap having a connected end and a free end, at least a part of said strap defining a closed loop sized to receive one or more of a user's fingers therethrough, said flexible strap being permanently connected at said connected end to said handle in said recess, said flexible strap being of a length and width sufficient to allow a user's hand to grasp said strap loop when said strap swings free for carrying said umbrella by said strap when desired by a user and to fit within said recess substantially flush with said exterior surface in a stowed position when desired by a user where the other end of said strap does not swing free, and holding means at least partially carried by at least one of said recess and said strap, said holding means cooperating with said strap to fasten said strap in said recess so as to be substantially flush with said exterior surface in said stowed position.

2. An umbrella as set forth in claim 1, said holding means comprising a two-part fastener with one part of said fastener being connected to the free end of said strap.

3. An umbrella as set forth in claim 2, the other part of said fastener being connected to one of said recess and said strap.

4. An umbrella as set forth in claim 2, said two-part fastener being a snap fastener.

5. An umbrella as set forth in claim 1, said holding means comprising press fit structure of said recess with said strap, said press fit structure of said recess cooperating with said strap to establish a friction fit between said strap and said recess for retaining said strap in said stowed position.

6. An umbrella as set forth in claim 1, the width of said recess being no greater than the width of said strap to define said holding means whereby said strap thereby being retained in said recess due to a friction fit relationship therewith.

7. An umbrella handle as set forth in claim 1, the length of said recess being sufficient to receive substantially the entire length of said strap therein.

8. An umbrella as set forth in claim 7, the width of said recess being no greater than the width of said strap to define said holding means whereby said strap thereby being retained in said recess due to a friction fit relationship therewith.

9. An umbrella as set forth in claim 1, said recess being in a plane generally transverse to the longitudinal axis of said handle.

10. An umbrella as set forth in claim 1, said recess being in a plane that is one of generally co-extensive with and generally parallel to the longitudinal axis of said handle.

11. An umbrella as set forth in claim 1, said recess being of a generally line configuration so that said strap is stowed in a generally line configuration.

12. An umbrella as set forth in claim 1, said recess being of a generally loop configuration so that said strap is stowed in a generally loop configuration.

13. An umbrella as set forth in claim 1, said recess being in the form of an annular groove, said groove being positioned generally transverse to the longitudinal axis of said handle.

* * * * *